US006867745B2

(12) United States Patent
Dunn, Jr. et al.

(10) Patent No.: US 6,867,745 B2
(45) Date of Patent: Mar. 15, 2005

(54) AM ANTENNA NOISE REDUCING

(75) Inventors: Charles E. Dunn, Jr., Boylston, MA (US); Robert Preston Parker, Westborough, MA (US)

(73) Assignee: Bose Corporation, Framingham, MA (US)

( * ) Notice: Subject to any disclaimer, the term of this patent is extended or adjusted under 35 U.S.C. 154(b) by 18 days.

(21) Appl. No.: 10/256,511

(22) Filed: Sep. 27, 2002

(65) Prior Publication Data

US 2004/0061659 A1 Apr. 1, 2004

(51) Int. Cl.[7] ..... H01Q 7/08
(52) U.S. Cl. ..... 343/788; 343/787; 343/745
(58) Field of Search ..... 343/787, 788, 343/745, 742, 741, 866, 867, 767, 744

(56) References Cited

U.S. PATENT DOCUMENTS 3,209,358 A 9/1965 Felsenheld
3,679,979 A * 7/1972 Krepps, Jr. et al. ..... 325/315
4,805,232 A * 2/1989 Ma ..... 343/788
6,529,169 B2 * 3/2003 Justice ..... 343/788

FOREIGN PATENT DOCUMENTS

| | | | |
|---|---|---|---|
| EP | 0733916 | A2 | 12/1995 |
| JP | 56 027514 | A | 3/1981 |
| JP | 62 283705 | A | 5/1988 |
| WO | WO 02/05236 | A1 | 1/2002 |
| WO | WO 02/45210 | A1 | 6/2002 |

* cited by examiner

*Primary Examiner*—Hoanganh Le
(74) *Attorney, Agent, or Firm*—Fish & Richardson P.C.

(57) ABSTRACT

An AM radio antenna circuit having a ferrite bar loop antenna comprises a resonating structure forming a balanced antenna circuit, a varactor diode tuning structure presenting a controllable capacitance to said winding structure, a DC path including the winding structure coupled to the varactor constructed and arranged to deliver a tuning signal to the varactor, and means for connecting the antenna circuit to the input of an external detector integrated circuit.

22 Claims, 1 Drawing Sheet

AM ANTENNA NOISE REDUCING

The present invention relates in general to radio antenna noise reducing and more particularly concerns novel apparatus and techniques for reducing interfering noise in the AM band with an AM antenna.

BACKGROUND OF THE INVENTION

Operation of electronic power controllers, such as a triac light dimmer, can create severe interfering noise in the AM radio band. The interfering noise may enter the radio through any of the mechanisms of capacitive coupling to the antenna, conduction through the AC mains, or magnetic coupling to the antenna. In home use, a major mode is through the AC mains.

Typical antennas for AM radios are external loop or internal loop types, such as ferrite rod loop AM antennas. External loop antennas typically use twisted pair lead-ins connected to a balanced input. Internal ferrite rod loop antennas are typically unbalanced, with one side of the loop at RF ground while the other side is connected to a varactor diode. An unbalanced pickup coil is typically used to drive the detector integrated circuit (IC).

It is an important object of the invention to reduce electrical interference in an AM radio with an improved antenna.

SUMMARY OF THE INVENTION

According to the invention, there is a loop antenna having winding structure with ends coupled to the input of the radiofrequency amplifying circuit and a varactor tuning diode structure coupled to the winding structure.

Other features, objects and advantages will become apparent from the following description when read in connection with the accompanying drawing in which:

DETAILED DESCRIPTION

Figure 1:
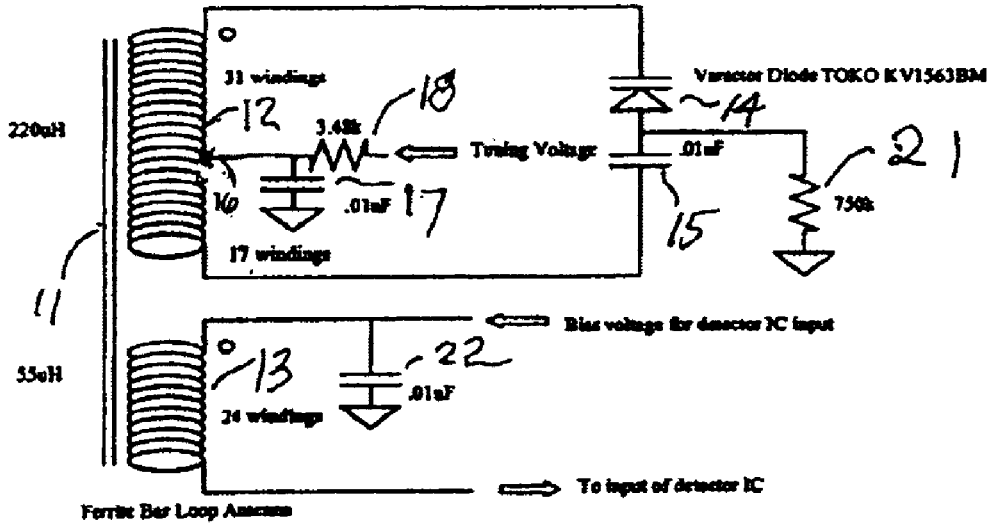
FIG. 1 is a schematic circuit diagram of an center grounded ferrite bar loop antenna according to the invention.

Referring to FIG. 1, there is shown a schematic circuit diagram of an embodiment of the invention incorporating a center grounded ferrite bar loop antenna. The circuit includes a ferrite bar 11 having a resonant circuit winding 12 and a pickup winding 13. One end of resonant circuit winding 12 is directly coupled to varactor tuning diode 14, the other end of winding 12 is coupled to varactor diode 14 through low impedance coupling capacitor 15. An intermediate tap 16 of resonant circuit winding 12 is coupled to a reference potential through a low impedance coupling capacitor 17. The reference potential is assumed to be ground for the rest of this disclosure, but it should be noted that the reference can be set to be any desired potential Intermediate tap 16 also receives a tuning voltage through resistor 18 for controlling the effective capacity of varactor diode 14 to tune the resonant circuitry to the frequency of the desired AM carrier. The junction of varactor diode 14 and low impedance capacitor 15 is connected to ground through resistor 21. Representative parameter values are set forth in FIG. 1. A low impedance bypass capacitor 22 couples the end of pickup winding 13 that receives a bias voltage for the detector integrated circuit input to ground. The other end of pickup winding 13 is connected to the input of the detector integrated circuit.

The embodiment of FIG. 1 balances the antenna circuit by placing the RF ground near the center of the resonant circuit winding 12. The intermediate tap 16 is preferably displaced from the physical center of winding 12 to account for the effects of unbalanced pickup coil 13 and the capacitance to the external environment of the conductors attached to the detector integrated circuit input. The position of intermediate tap 16 should be offset from the center of the winding coil and may be experimentally determined for maximum interference reduction. In this example, intermediate tap 16 was located 16 turns from the capacitor end and 31 turns from the varactor end of winding 12 in a 220 microhenry inductance with winding 13 having 24 turns and an inductance of 55 microhenries to provide at least 27 dB improvement in line conducted interference rejection.

It is possible to eliminate coil 13 of FIG. 1. In this case, an appropriate intermediate point along coil 12 is located where an RF signal can be tapped off. This point is chosen such that the coil impedance matches the input impedance requirements of the circuitry coupled to this intermediate tap, which would typically be the RF input of the detector IC.

Figure 2:
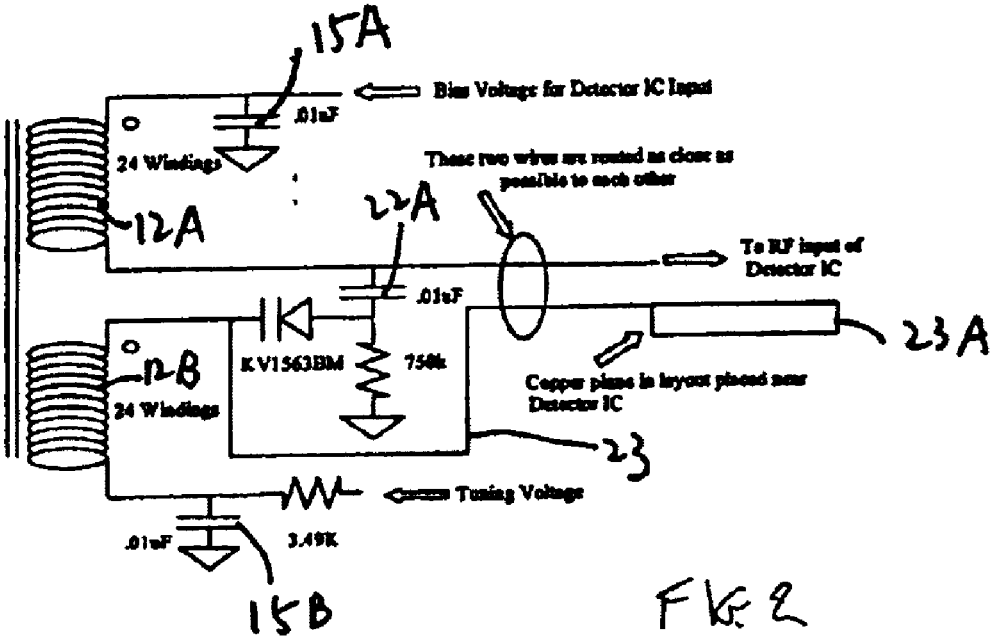
FIG. 2 is a schematic circuit diagram of a end grounded ferrite bar loop antenna according to the invention.

Referring to FIG. 2, there is shown another embodiment of the invention comprising coils 12A and 12B forming the resonating winding with the opposed ends maintained at RF ground through capacitors 15A and 15B, respectively to balance the antenna. Either winding provides the correct driving point impedance for the detector integrated circuit so pickup coil 13 is unnecessary. Therefore, the input to the detector chip is now taken directly from the junction of windings 12A and 12B maintained at the same RF potential through capacitor 22A. The negative effects of stray capacitance can be reduced by adding an electrically conductive structure, such as a geometric structure formed in the printed circuit board (PCB) copper, to the circuit. As shown in FIG. 2, an additional trace wire 23 is added to the hot side of winding 12B and is routed as close as practical to the lead connected to the RF input of the detector IC, along its entire length. The minimum spacing between the lead the added structure is determined by the PCB design rules used to design and manufacture the PCB. The rules are chosen based on cost and performance requirements. Smaller trace spacing typically provides better system performance in terms of reducing stray effects, at a higher cost. In the present invention, a trace spacing of 0.006 inches was implemented.

Additional copper structure 23A at the end of this wire further compensates the negative effect created by the capacitance of the conductors connected to the detector integrated circuit input. In a specific form of this embodiment, each of windings 12A and 12B has 24 turns.

There has been described novel apparatus and techniques for significantly reducing undesired noise entering the antenna circuit of an AM radio. It is evident that those skilled in the art may now make numerous uses and modifications of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A tunable AM radio antenna comprising, a ferrite bar loop antenna comprising, a ferrite bar having a resonating structure forming a balanced antenna circuit, wherein said resonating structure has a first winding structure, an antenna tuning structure comprising, a varactor diode tuning structure presenting a controllable capacitance to said winding structure, a DC path including said first winding structure coupled to said varactor diode constructed and arranged to deliver a tuning signal to said varactor diode tuning structure, wherein said first winding structure has two ends, and an intermediate tap is constructed and arranged to carry said tuning signal and via said DC path, and, means for connecting said tunable antenna to the input of an external detector circuit.

2. The tunable AM radio antenna in accordance with claim 1, wherein said intermediate tap is maintained at a reference potential at radio frequencies.

3. The tunable AM radio antenna in accordance with claim 2, wherein said reference potential is circuit RF ground.

4. The tunable AM radio antenna in accordance with claim 1, wherein the location of said intermediate tap on said first winding structure is offset from the center of said winding to account for interferences.

5. The tunable AM radio antenna in accordance with claim 1 wherein said means for connecting further includes a structure having a second intermediate tap on said first winding structure wherein said second intermediate tap is connected to the input of said external detector circuit.

6. The tunable AM radio antenna in accordance with claim 5, wherein the location of said second tap on said first winding structure is chosen such that the coil impedance of said first winding structure matches the impedance requirement of said external detector circuit.

7. The tunable AM radio antenna in accordance with claim 1 wherein the first end of said first winding structure is directly coupled to said varactor diode tuning structure and the second end of said first winding structure is coupled to said varactor diode tuning structure via a capacitor.

8. The tunable AM radio antenna in accordance with claim 1 wherein said means for connecting further includes a second winding structure having two ends with a first end of said second winding structure constructed to receive an external signal and a second end of said second winding structure connected to an external detector circuit.

9. The tunable AM radio antenna in accordance with claim 8 wherein the external signal is a bias voltage.

10. A tunable AM radio antenna in accordance with claim 8, wherein said intermediate tap is maintained at a reference potential at radio frequencies.

11. A tunable AM radio antenna in accordance with claim 10, wherein said reference potential is circuit RF ground.

12. A tunable AM radio antenna in accordance with claim 8, wherein the location of said intermediate tap on said first winding structure is offset from the center of said first winding structure to account for interferences.

13. A tunable AM radio antenna in accordance with claim 10, wherein the first end of said first winding structure is directly coupled to said varactor diode tuning structure and the second end of said first winding structure is coupled to said varactor diode tuning structure via a capacitor.

14. A tunable AM radio antenna comprising, a ferrite bar loop antenna comprising, a ferrite bar having a resonating structure forming a balanced antenna circuit, wherein said resonating structure having a first winding structure and second winding structure, each winding structure having internal and external ends, an antenna tuning structure comprising, a varactor diode tuning structure presenting a controllable capacitance to said first and second winding structures, a DC path including said second winding structure coupled to said varactor diode tuning structure, constructed and arranged to deliver a tuning signal to said varactor diode tuning structure, wherein the external end of said first winding structure is constructed to receive an external signal and the internal end of said first winding structure is connected to an external detector circuit by connecting structure;

wherein the external end of said second winding structure is constructed and arranged to receive said tuning signal.

15. The tunable AM radio antenna comprising, a ferrite bar loop antenna comprising, a ferrite bar having a resonating structure forming a balanced antenna circuit, wherein said resonating structure having a first winding structure and second winding structure, each winding structure having internal and external ends, an antenna tuning structure comprising, a varactor diode tuning structure presenting a controllable capacitance to said first and second winding structures, a DC path including said second winding structure coupled to said varactor diode tuning structure, constructed and arranged to deliver a tuning signal to said varactor diode tuning structure, wherein the external end of said first winding structure is constructed to receive an external signal and the internal end of said first winding structure is connected to an external detector circuit by connecting structure;

wherein the external end of said second winding structure is constructed and arranged to receive said tuning signal, wherein said external end of said first winding and said external end of said second winding are maintained at a reference potential at radio frequencies.

16. The tunable AM radio antenna in accordance with claim 15, wherein said reference potential is circuit RF ground.

17. A tunable AM radio antenna comprising, a ferrite bar loop antenna comprising, a ferrite bar having a resonating structure forming a balanced antenna circuit, wherein said resonating structure having a first winding structure and second winding structure, each winding structure having internal and external ends, an antenna tuning structure comprising, a varactor diode tuning structure presenting a controllable capacitance to said first and second winding structures, a DC path including said second winding structure coupled to said varactor diode tuning structure, constructed and arranged to deliver a tuning signal to said varactor diode tuning structure, wherein the external end of said first winding structure is constructed to receive an external signal and the internal end of said first winding structure is connected to an external detector circuit by connecting structure;

wherein the external end of said second winding structure is constructed and arranged to receive said tuning signal, wherein said second winding structure is directly coupled to said varactor diode tuning structure and said first winding structure is coupled to said varactor diode tuning structure via a capacitor.

18. A tunable AM radio antenna comprising, a ferrite bar loon antenna comprising, a ferrite bar having a resonating structure forming a balanced antenna circuit, wherein said resonating structure having a first winding structure and second winding structure, each winding structure having internal and external ends, an antenna tuning structure comprising, a varactor diode tuning structure presenting a controllable capacitance to said first and second winding structures, a DC path including said second winding structure coupled to said varactor diode tuning structure, constructed and arranged to deliver a tuning signal to said varactor diode tuning structure, wherein the external end of said first winding structure is constructed to receive an external signal and the internal end of said first winding structure is connected to an external detector circuit by connecting structure;

wherein the external end of said second winding structure is constructed and arranged to receive said tuning signal, wherein the internal end of said second winding structure is further connected to an electrically conducting structure for minimizing stray effects.

19. The tunable AM radio antenna in accordance with claim 18 wherein the electrically conducting structure is a geometric structure formed in a printed circuit board having a trace wire.

20. The tunable AM radio antenna in accordance with claim 18 wherein the electrically conducting structure is located physically within a predetermined distance to the connecting structure.

21. The tunable AM radio antenna in accordance with claim 19 wherein the trace wire is located physically within a predetermined distance to the internal end of said second winding.

22. The tunable AM radio antenna in accordance with claim 21 wherein the predetermined distance in claim 21 is the minimum trace spacing on the printed circuit board.

* * * * *